United States Patent [19]

Goodworth

[11] 4,226,041

[45] Oct. 7, 1980

[54] PREPACKAGED AMMUNITION SYSTEM

[76] Inventor: William H. Goodworth, 3112 Carey Ave., Davenport, Iowa 52803

[21] Appl. No.: 921,390

[22] Filed: Jul. 3, 1978

[51] Int. Cl.[3] ..... F41C 25/02

[52] U.S. Cl. ..... 42/50

[58] Field of Search ..... 42/50, 6, 18, 22

[56] References Cited

U.S. PATENT DOCUMENTS

| | | | |
|---|---|---|---|
| 2,773,325 | 12/1956 | Hill | 42/50 |
| 2,882,635 | 4/1959 | Hill | 42/50 |
| 2,910,795 | 11/1959 | Agren | 42/50 |
| 3,603,020 | 9/1971 | Wiese | 42/50 |
| 3,676,946 | 7/1972 | Sibilia | 42/50 |
| 3,906,652 | 9/1975 | Evans | 42/50 |

*Primary Examiner*—Charles T. Jordan

*Attorney, Agent, or Firm*—Robert P. Gibson; Nathan Edelberg

[57] ABSTRACT

A prepackaged ammunition system wherein the spring, follower and feed lips are built into the weapon and disposable magazines are filled with cartridges which may be fed into the weapon.

9 Claims, 7 Drawing Figures

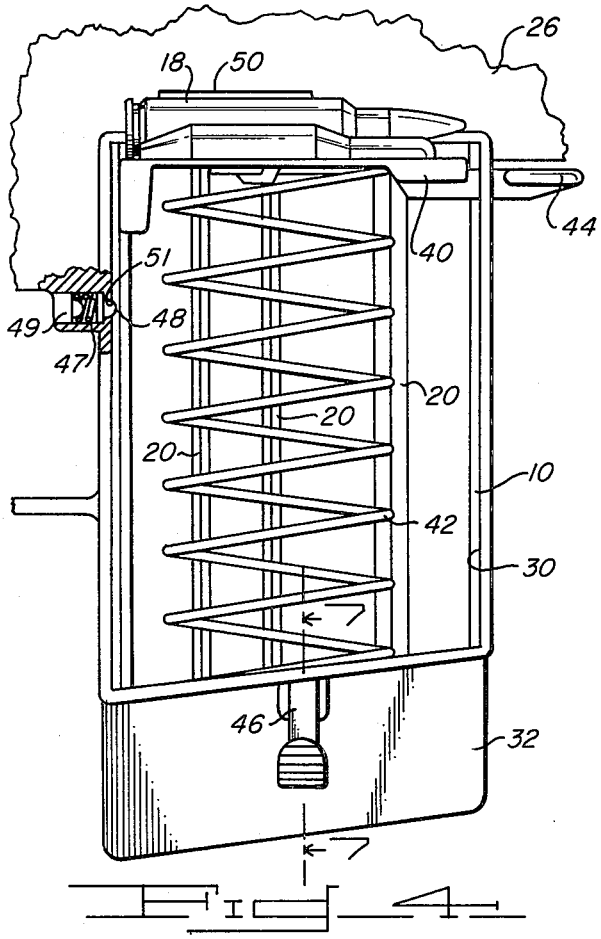
FIG. 4
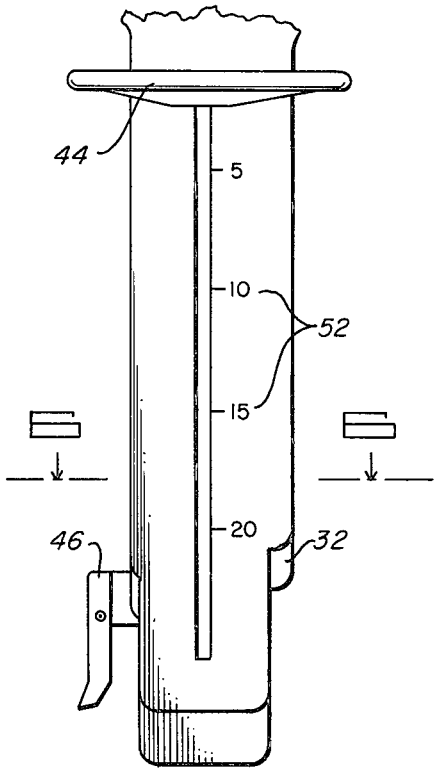
FIG. 5
FIG. 6
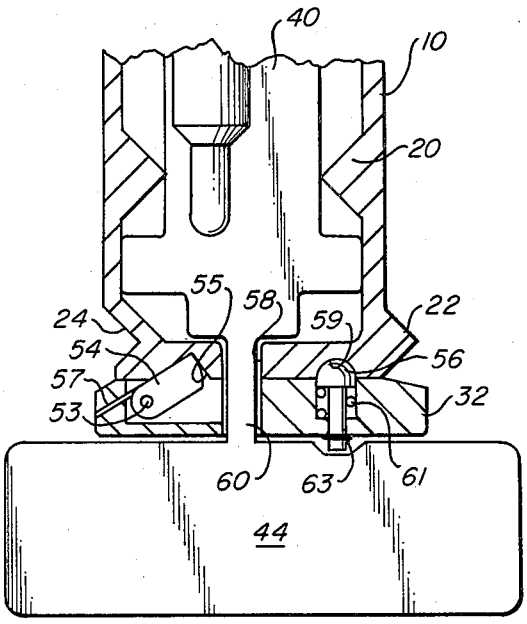
FIG. 7
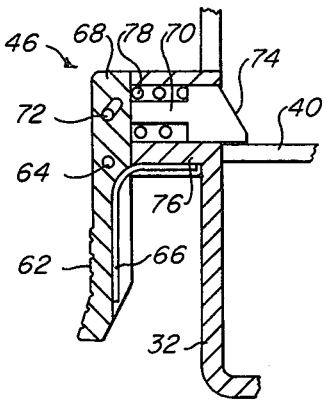

PREPACKAGED AMMUNITION SYSTEM

GOVERNMENT RIGHTS

The invention described herein may be manufactured and/or used by or for the Government for governmental purposes without the payment of any royalty thereon.

BACKGROUND OF THE INVENTION

At present, military rifles are issued with metal reusable magazines. While the magazines are designed to be reloaded and used many times, this is usually not practical in a combat situation. A GI normally carries seven or eight loaded magazines in combat. During an assault it is much easier to simply discard the empty magazines and insert another loaded one. While this is fast and efficient for the combat soldier it is also very expensive. For example, at the time of the Vietnam conflict the magazine unit price for the standard issue rifle was $1.50. The magazines were lost at a rate of about one million per month. This means an annual cost of about 18 million dollars. Based on this annual cost, development of an inexpensive, disposable magazine would be very desirable.

There are several other factors which make a disposable magazine desirable. The first is that such a magazine could be made of plastic. This would mean further savings because manufacturing costs would be less. Also components which have typically been parts of the magazine in conventional systems, could be designed into the rifle. In other words, the feed lips, follower, and follower spring would be built into the weapon itself, therefore, these components would not be thrown away with each magazine. Locating the feed lips within the weapon should also increase the reliability of feeding. This is because the feed lips can be made of higher quality material and located more precisely with respect to the weapon chamber. Also they would not be exposed and subject to deformation as is common with conventional magazines. Additionally by incorporating the aforementioned components into the weapon the magazine weight would be reduced. Since the soldier carries only one rifle but several magazines, the total load would be reduced.

These disposable magazines could also be factory machine loaded and sealed. This would assure optimum ammunition condition regardless of environmental conditions. This would eliminate the possibility of feeding bent or corroded ammunition which is a common cause of weapon malfunctions.

SUMMARY OF THE PRESENT INVENTION

A disposable magazine in accordance with the present invention would basically consist of a plastic box. This box would have vertical internal ridges to stiffen the box and to accurately position the rounds for feeding into the weapon. Additionally the box would have a quickly removable moisture proof seal. This could be designed to be removed by means of a pull strip or tab, similar to cigarette or chewing gum packages. This would allow the magazine to be quickly made ready for firing.

A magazine of this type would be used in conjunction with a specially designed weapon. Such a weapon would have a magazine housing which surrounds the magazine box when it is inserted into the weapon. The magazine housing would not only protect the magazine box but could also be used as a unipod for prone firing. Also foreign material cannot enter the base of the magazine or housing as is possible when conventional magazines contact soiled surfaces.

As stated earlier the feed lips, follower and follower spring would be built into the weapon itself. The follower could be operated by an external lever attached to it. This lever could also provide a visual indication of the number of rounds remaining in a magazine. To load the weapon the follower lever would be completely depressed. A catch would retain the follower until the magazine is inserted. The magazine seal is first removed by means of the pull strip. It is then inserted into the weapon where three spring loaded detents position and retain the box. The follower lever is then released. The rounds are then pressed against the internal feed lips by the follower/follower spring and the weapon is ready to fire.

BRIEF DESCRIPTION OF DRAWINGS

FIG. 4 is a side elevational view of the magazine inserted in the weapon, with the front side removed for clarity, FIG. 5 is a front elevational view of the magazine housing on the weapon, FIG. 6 is a partial sectional view of the magazine taken along line 6—6 in FIG. 5, and FIG. 7 is a partial sectional view of the follower latch taken along line 7—7 in FIG. 4.

DETAILED DESCRIPTION OF ILLUSTRATIVE EMBODIMENTS

Figure 1:
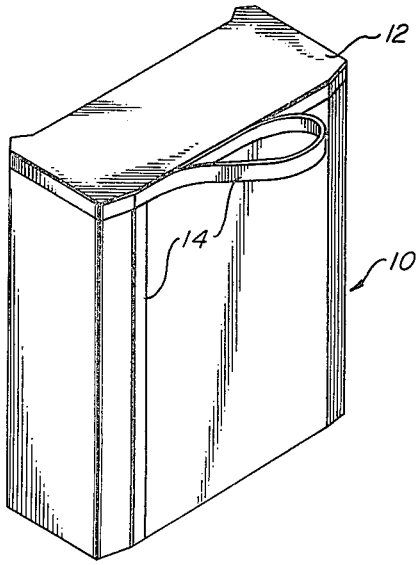
FIG. 1 is a perspective view of the sealed disposable magazine.

In FIG. 1 there is shown a perspective view of the disposable magazine 10. The magazine is provided with an external protective wrapper 12 preferably made of cellophane or similar material. The wrapper provides an environmental seal for the magazine from the time of manufacture until it is ready for use. When the magazine 10 is ready to be used the wrapper 12 can be quickly removed by means of a pull strip 14. This strip 14 is similar to those commonly found on cigarette packages.

Figure 2:
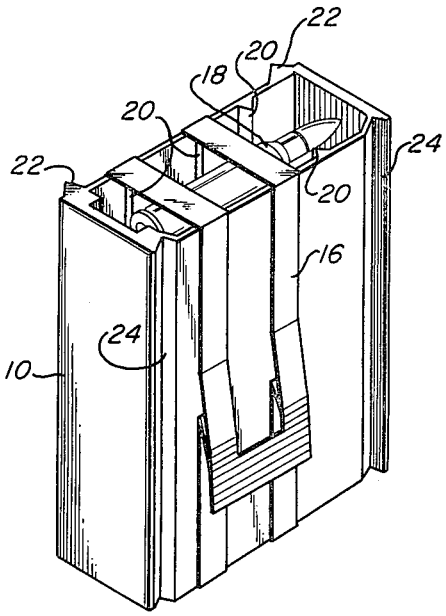
FIG. 2 is a perspective view of a first embodiment with the outer wrapping removed.
Figure 3:
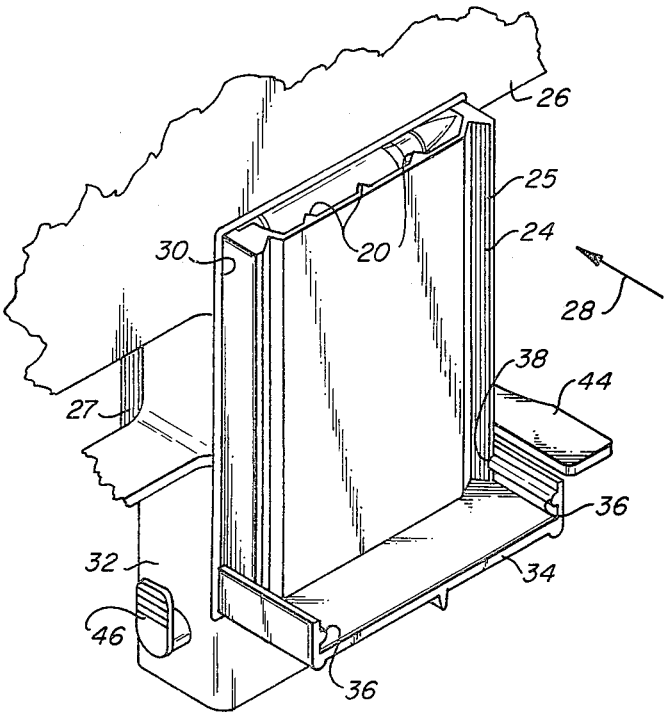
FIG. 3 is a perspective view of a second embodiment of the disposable magazine shown with the detachable bottom being removed, being inserted into the weapon.

FIG. 2 shows a first embodiment of the magazine 10 after the protective outer wrapper 12 has been removed. In this embodiment a second pull strip 16 is provided to retain the ammunition 18 in the magazine until it is inserted into the weapon. The magazine 10 is provided with internal ridges 20. These ridges 20 serve to stiffen the box and accurately position the ammunition 18. The magazine is also provided with external ridges 22 and grooves 24. These ridges 22 and grooves 24 provide alignment between two magazines when loading the magazine into the weapon. FIG. 3 shows a magazine 25 being loaded into a weapon 26. When loading, the full magazine 25 is pushed in from the side of the weapon 26 in the direction of arrow 28. In this position the external ridges 22 on the magazine 25 being loaded rest in the grooves 24 of the empty magazine 27 already in the weapon. This aligns the magazine 25 being loaded with the tapered opening 30 in the magazine housing 32 on the weapon 26. As the full magazine 25 is pushed into the magazine housing 32 the empty magazine 27 is pushed out the opposite side as shown in FIG. 3.

The magazine 25 shown in FIG. 3 is a second embodiment of the present invention. This embodiment does not utilize a pull strip to retain the ammunition. Instead a removable bottom 34 covers the lower portion of the magazine. The bottom is attached to the magazine 25 by ridges 36 which mate with grooves 38. The opening 30 in the magazine housing 32 is not large enough to accept the bottom 34. Therefore when the magazine 25 is inserted into the weapon 26 the bottom 34 slides off. Before a magazine can be inserted into or removed from the magazine housing 32 the follower 40 and follower spring 42 (see FIG. 4) must be depressed. This is done by depressing the follower handle 44 until the follower 40 is retained by the follower latch 46. When latched, the follower 40 and spring 42 are held in the bottom portion of the magazine housing 32. This allows the magazines to be easily inserted and removed.

FIG. 4 shows a magazine 10 positioned in the weapon 26. The front side of the magazine is removed to show the internal structure. Note that when used with the first embodiment the follower latch 46 may be centrally located on the side of the magazine housing 32. In this position the latch is located near the center of the spring. This provides greater latch reliability and smoother operation. A spring biased detent 48 is shown in a cut away section. Spring 47 rests against plug 49 and pushes detent 48 into engagement with a small notch 51 in the magazine 10. This detent 48 and two others (shown in FIG. 6) serve to position and retain the magazine in the magazine housing 32.

As can be seen in FIG. 4 the follower 40 and spring 42 enter the magazine from the bottom when the latch 46 is released. The rounds 18 (one round is shown for clarity) are then pushed up against the internal feed lips 50. The feed lips 50 retain the rounds in the magazine 10 until they are fed to the chamber (not shown) by conventional means. By making the feed lips 50 an integral part of the weapon 26 more reliable feeding should be achieved. This is because they can be more accurately positioned relative to the chamber. They are also not subject to tolerance stack ups of magazine catches nor can they be bent or damaged by bumps or dropping, etc.

FIG. 5 shows the magazine housing from the front of the weapon. The numerals 52 provide a quick indication of the number of rounds remaining in a magazine.

FIG. 6 shows a partial section of the magazine 10 along line 6—6 in FIG. 5. This view shows the two additional positioning and retaining detents 54, 56. Detent 54 pivots on pin 53 and is urged into engagement with notch 55 by a torsion spring 57. Detent 56 is urged into notch 59 by spring 61. This detent 56 is retained in the magazine housing 52 by a snap ring 63. These detents 54, 56 cooperate with the third detent 48 to retain the magazine 10 while firing. They also prevent the magazine 10 from separating at slot 58 when spring pressure is applied. Slot 58 is necessary to provide clearance for the connecting link 60 between the follower 40 and the follower handle 44. This slot can be environmentally self sealing with flexible flaps (not shown).

FIG. 7 is a sectional view taken along line 7—7 of FIG. 4. This view shows the detail of the follower latch 46 components. Button 62 pivots on pin 64 and is biased to the position shown by a leaf spring 66. The upper end 68 of button 62 is pivotally connected to catch 70 at pin 72. When the follower handle 44 is depressed the follower 40 is moved downward until the follower 40 contacts the angled surface 74 on catch 70. Continued downward movement of the follower 40 depresses the catch 70 into the latch housing 76. When the follower 40 has cleared the lower edge of the catch 70, spring 78 returns the catch 70 to the position shown in FIG. 7. The follower 40 is then retained in the downward position as shown. To release the follower 40, button 62 is depressed. This retracts the catch 70 and the follower 40 is driven upward by follower spring 42.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A prepackaged ammunition system comprising a weapon having a chamber, ammunition feed lips and a follower thereon, said weapon having a housing, a disposable magazine having ammunition therein adapted for insertion into said housing, said magazine comprising walls surrounding a vertical stack of cartridges, said housing having said follower vertically moveable therein and latch means for retaining said follower in a downward position until after insertion of said magazine, said housing having detent means thereon to permit unidirectional insertion and removal of said magazine therefrom.

2. A prepackaged ammunition system as set forth in claim 1 wherein said follower is spring urged upwardly against the bottommost cartridge when released by said latch means.

3. A prepackaged ammunition system as set forth in claim 1 wherein one of said magazine walls has a vertical slot therein through which a link connects an external handle with said follower to permit manual depression of said follower while said magazine remains in said housing.

4. A prepackaged ammunition system as set forth in claim 1 wherein said detent means positions and retains said magazine in said housing in proper alignment with said feed lips whereby the uppermost cartridge in said magazine is properly positioned for feeding into the chamber of said weapon.

5. A prepackaged ammunition system as set forth in claim 1 wherein ammunition is retained in said magazine by means of pull strips removeable after said magazine has been inserted into said housing.

6. A prepackaged ammunition system as set forth in claim 1 wherein ammunition is retained in said magazine by means of a removeable wrapper and a removeable bottom, said bottom being removed as said magazine is inserted into said housing.

7. A prepackaged ammunition system as set forth in claim 6 wherein said bottom slides on ridges which engage grooves in said magazine.

8. A prepackaged ammunition system as set forth in claim 1 wherein the insertion of said magazine into said housing expels a second said magazine previously contained in said housing.

9. A prepackaged ammunition system comprising a weapon having ammunition feed lips and a follower thereon, said weapon having a housing, a disposable magazine having ammunition therein adapted for insertion into said housing, said magazine comprising walls surrounding a vertical stack of cartridges, said housing having said follower vertically moveable therein and latch means for retaining said follower in a downward position until after insertion of said magazine, said ammunition being retained in said magazine by means of pull strips removeable after said magazine has been inserted into said housing.

* * * * *